United States Patent [19]

Grevisse

[11] Patent Number: 4,569,291

[45] Date of Patent: Feb. 11, 1986

[54] ARTICULATED BOGIE

[75] Inventor: Louis Grevisse, Asnieres, France

[73] Assignee: Societe M.T.E., Puteaux, France

[21] Appl. No.: 613,014

[22] Filed: May 22, 1984

Related U.S. Application Data

[63] Continuation of Ser. No. 258,823, Apr. 29, 1981, abandoned.

[30] Foreign Application Priority Data

May 23, 1980 [FR] France ..... 80 11623

[51] Int. Cl.[4] ..... B61F 5/08; B61F 5/10; B61F 5/12

[52] U.S. Cl. ..... 105/193; 105/197 R; 105/224.1

[58] Field of Search ..... 105/182 R, 197 R, 197 A, 105/197 B, 206 R, 224.1, 185, 189, 193, 208, 208.1, 208.2

[56] References Cited

U.S. PATENT DOCUMENTS

| | | | |
|---|---|---|---|
| 2,231,195 | 2/1941 | Piron | 105/182 R |
| 2,740,360 | 4/1956 | Janeway | 105/197 R X |
| 2,836,130 | 5/1958 | Russel | 105/224.1 |
| 2,874,648 | 2/1959 | Dilworth | 105/197 R X |
| 3,022,748 | 2/1962 | Lich | 105/197 B X |
| 3,200,771 | 8/1965 | Dobson et al. | 105/197 B X |
| 3,220,358 | 11/1965 | Péras | 105/224.1 |
| 3,352,255 | 11/1967 | Sheppard | 105/197 R |
| 3,628,465 | 12/1971 | Dobson et al. | 105/197 A X |
| 3,636,885 | 1/1972 | Cunningham | 105/197 R X |
| 3,646,893 | 3/1972 | Sundby | 105/197 B X |
| 3,990,372 | 11/1976 | Eggert et al. | 105/224.1 X |
| 4,131,069 | 12/1978 | List | 105/182 R X |
| 4,242,966 | 1/1981 | Holt et al. | 105/197 R X |

*Primary Examiner*—Randolph A. Reese
*Assistant Examiner*—David F. Hubbuch
*Attorney, Agent, or Firm*—Pollock, Vande Sande & Priddy

[57] ABSTRACT

An articulated bogie for railroad vehicles, comprising lateral equalizing bars connecting the axle boxes, and connected to each other by a primary cross member. The lateral equalizing bars (3) are connected directly to the axle boxes (2) without the use of suspension. The primary cross member (6) is resiliently carried by vertical supports on each equalizing bar (3), the supporting arrangement being provided at each end of the cross member, the two points (7) of which are spaced and equidistant from the center. A secondary load-bearing cross member (11) is carried on the primary cross member (6) by a secondary suspension system (10).

8 Claims, 3 Drawing Figures

ARTICULATED BOGIE

This application is a continuation of application Ser. No. 258,823, filed 4/29/81, now abandoned.

FIELD OF THE INVENTION

The present invention refers to an articulated bogie for railroad vehicles, more particularly intended for travel on railroad track which is in a poor state.

Such track which may be old or badly maintained, is very sinuous and often badly supported, and includes local deformations. Skewing at the curves and the deformations result in a considerable lack of trueness, in other words a lack of parallelism of the level of the rails, whether they are in the unloaded state or more noticeably when they are subject to loading when trains are passing over them.

BACKGROUND

Bogies which are most commonly found in current use and are not articulated, consist of a rigid chassis made up by two side frames and at least one cross member, and are in no condition to absorb anything more than a slight error in level, using their suspension systems. The rigidity of the frame prevents the vertical twisting deformations which would be needed to maintain the same amount of loading on all the wheels. Some wheels can consequently be in a position where they are not subject to loading, which may bring about a derailment. Obviously this risk increases under certain operating conditions.

Various types of articulated bogies are already known, which do allow a certain degree of deformation of their frame, but these suffer from numerous disadvantages, due to the complexity of their design; this results in high cost, both as regards their manufacture and their maintenance during operation.

The present invention provides a novel solution, which is simpler and more economical, for the provision of an articulated bogie.

SUMMARY OF THE INVENTION

The invention is applied to an articulated bogie for railroad vehicles comprising lateral equalizing bars which connect the axle boxes, and which are connected by a primary cross-member, with a secondary cross-member receiving the load from the wagon body.

According to the invention, the lateral equalizing bars are directly connected to the axle boxes, without suspension, but with the insertion of a slightly deformable resilient component. The primary cross-member bears resiliently in the vertical sense on each equalizing bar, the bearing arrangement being provided at each end of the cross member at two points which are spaced and equidistant from the center, with controlled guiding in the horizontal plane, the secondary cross member receiving the load being arranged to rest on the primary cross member via the intermediary of a secondary suspension.

BRIEF DESCRIPTION OF THE DRAWINGS

The invention will be better understood with reference to one particular embodiment which is given solely by way of example and shown in the attached drawings.

Figure 1:
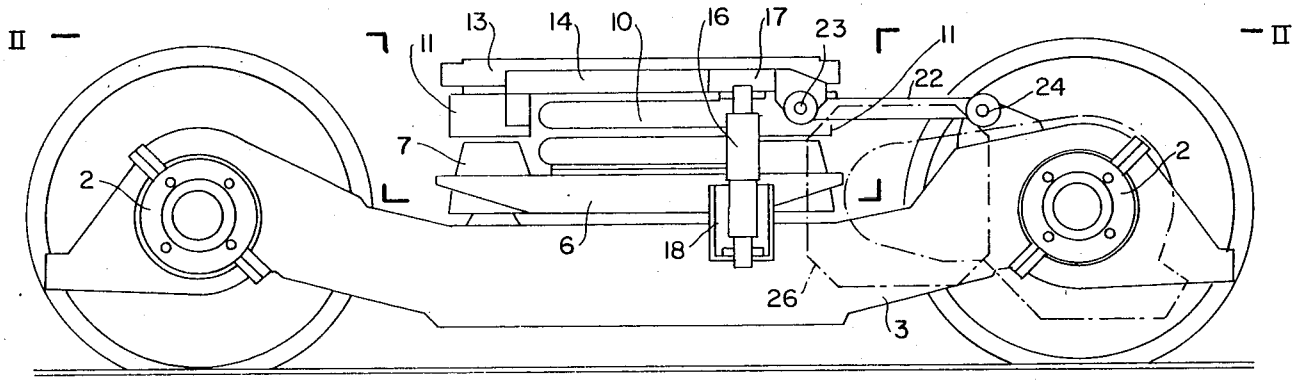
FIG. 1 is a simplified side view of a bogie arranged according to the invention.
Figure 3:
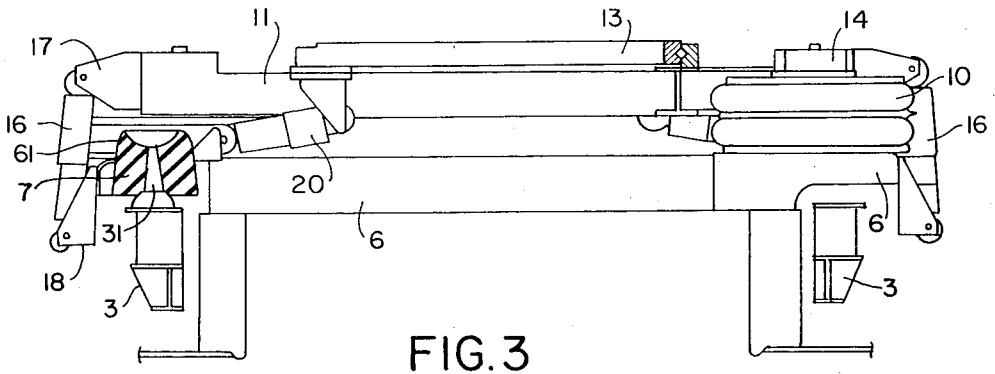
FIG. 3 is a sectional view according to line III—III in FIG. 2.
Figure 2:
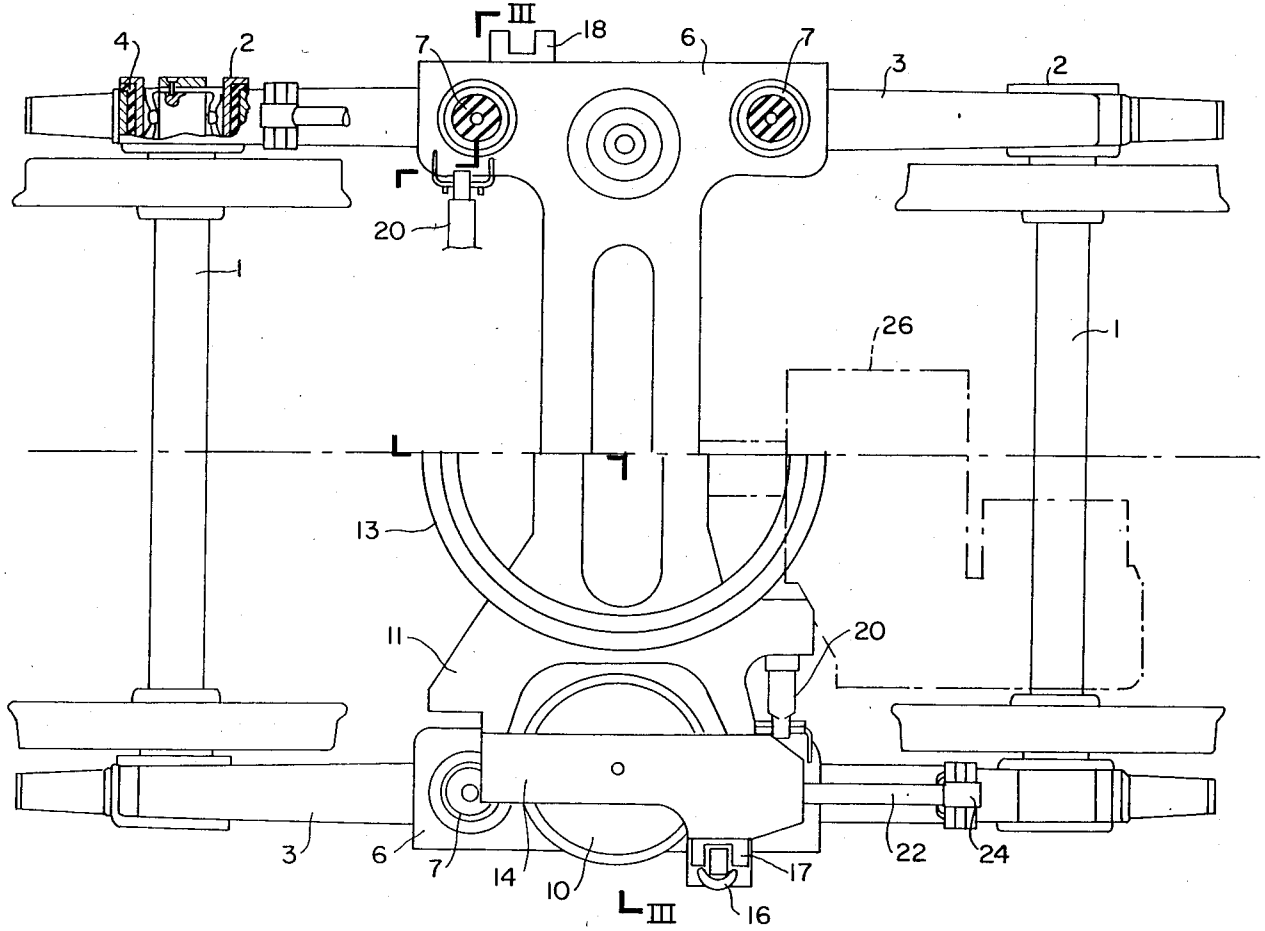
FIG. 2 is a partial plan view of the bogie, and a partial view according to the line II—II in FIG. 1.

In a general manner these drawings are simplified representations in which, in order not to provide too much detail, certain components which are nevertheless important are not shown, such as the braking equipment, since the latter can be completely conventional and is not actually concerned by the invention. In the same way, the motor equipment has only been shown (in FIGS. 1 and 2) in silhouette, using dashed and dotted lines, and for a single motor only.

DETAILED DESCRIPTION OF AN EMBODIMENT

With reference now to all these figures, it will be seen that the two axles 1 are mounted in a conventional manner on the axle boxes 2, using a double row of rollers, so that there is no angular play with respect to the axis of the axle. Each one of the two axle boxes on one side of the bogie is held at each end of a lateral equalizing bar 3, a rubber sleeve 4 being inserted between the two to enable a very slight degree of deformation.

At its transverse axis, the bogie includes a cross member 6 the ends of which are spread out in a T-shape, and each of these bears on a lateral equalizing bar 3. At each end, the supporting arrangement is provided by two elastic rubber blocks 7, each of which is enclosed between an outer cup member 61 which is rigidly fixed to the cross member 6, and a central pin 31 which is rigidly fixed to the equalizing bar 3. Each supporting arrangement consequently makes up a resilient vertical suspension, but which remains guided in the horizontal plane. It is thus guaranteed that the axles 1 of the bogie will be parallel, both by the fitting of the axle boxes into the equalizing bars 3, and by the cross member 6, the four elastic blocks 7 of which perform, in the horizontal plane, the function of the rigid diagonals of a bracing arrangement.

In the vertical plane, the elastic blocks assume the function of a primary or first stage suspension, while at the same time allowing longitudinal tilting of the equalizing bars 3 with respect to the cross member 6, which has the effect of providing a deformable chassis.

The second stage of the suspension between the wagon body and the cross member 6 is made up by springs of the conventional type 10, which are carried by the cross member 6 at each one of its ends, the cross member 11 carrying the load resting on these. The connection between the wagon body and the cross member 11 which carries the load is shown here in its usual form of a ball or roller bearing ring 13, but this could also, in a completely usual manner, be provided by any other system such as a pivot and load carrying bolster arrangement. In order to facilitate the lowering of the wagon body, the cross member 11 carrying the load is here in the form of a branch member at its ends, so that it extends at both sides of the springs 10, while the ends of the branches are connected by a bridge 14, which bears on the springs 10.

Damping of vertical oscillations in the secondary suspension is attained by means of the shock absorbers 16, which are fixed, firstly to a support 17 which is rigidly fixed to the bridge 14, and secondly to a bearing surface 18 which is rigidly fixed to the cross member 6. In the same way, transverse oscillations are damped by the shock absorbers 20 which are connected in the same way to the load-bearing cross member 11 and the primary cross member 6.

Connection in the longitudinal sense, which provides for transmission of tractional and braking forces, is provided by means of connecting rods 22, which articulate firstly at 23, on a support which is rigidly fixed to an extension of the bridge 14, and consequently of the load-bearing cross member 11 and secondly, at 24, on a support which is rigidly fixed to the equalizing bar 3. In the conventional manner, the articulations of the connecting rods 22 may include resilient components.

The braking components which are not shown in the drawings may be carried either by the equalizing bars 3 or by the cross member 6, depending on the type of brake used and the arrangements chosen.

The same applies to the motor equipment; if a motorized bogie is being provided, one could easily adopt a conventional suspension arrangement in which, for example, the motor 26 is carried both by a support rigidly fixed to the cross member 6, and by the transmission housing which bears on the axle.

It will finally be noticed that the bogie which has thus been provided has its side frame or equalizing bars arranged so that they are not rigidly fixed to the cross member, thereby providing the necessary degree of flexibility between these components for the wheel to be able to follow the irregularities present in imperfect track, without their not being subject to loading. Moreover, the solution which has thus been presented only employs components of relatively small dimensions and of simple shapes, making possible a development towards techniques aimed at reducing weight, in particular the use of light-weight alloys.

For the user, the absence of frictional components and components which wear results in a greater degree of safety and in reduced maintenance costs.

Clearly the invention is not strictly limited to the embodiment which has just been described by way of example, but it also covers embodiments which only differ from what has been described in details, in variations of the practical arrangement, or by the use of equivalent means. Thus, for the primary suspension between the cross member 6 and the equalizing bars 3, one could, for example, replace the rubber blocks by helical springs, associated with an axial guiding arrangement for limiting flexibility in the transverse sense. In the same way, if the elastic components of the secondary suspension between the cross member carrying the load and the primary cross member were sufficient to transmit the longitudinal forces, one could eliminate the direct connection using the connecting rods between the load-carrying cross member and the equalizing bars, 3.

I claim:

1. Articulated bogie for railroad vehicle, comprising two lateral equalizing bars (3) directly connecting axle boxes (2), an element of elastic material being inserted between each said axle box and said equalizing bar so as to allow a slight deformation, a primary cross-member (6) which bears on said equalizing bars by means of elastic supports (7) providing an elastic vertical suspension with limited flexibility in the transverse sense so that said equalizing bars are not rigidly fixed to said primary cross member, said elastic supports being distributed at four points with two points on each equalizing bar and equidistant from the center, a secondary cross member (11) which rests on springs (10) being carried by said primary cross member (6) at each of its ends, said secondary cross member (11) bearing the load of said vehicle by a pivot (13) for connection and articulation with the vehicle body and a direct longitudinal connection (22) between said secondary cross-member (11) and said equalizing bars, at least one motor unit (26) being carried by said primary cross member (6).

2. Articulated bogie according to claim 1, wherein said primary cross member (6) has ends which are spread out in a T-shape.

3. Articulated bogie according to claim 1 or 2, wherein said secondary cross-member (11) has the form of a branch member at its ends so that it extends at both sides of the springs (10) while the ends of the said branches are connected by a bridge which bears on said springs (10).

4. Articulated bogie according to claim 3, wherein said pivot (13) is a bearing ring.

5. Articulated bogie according to claim 1 or 2, wherein said longitudinal connection comprises connecting rods (22) articulated both to said secondary cross member (11) and to said equalizing bar (3).

6. Articulated bogie according to claim 1 or 2, comprising shock absorbers (20, 16) having oppositely disposed ends, one of said ends being attached to said secondary cross-member (11, 14) and the other of said ends being attached to said primary cross-member (6).

7. Articulated bogie according to claim 1 or 2, wherein said element (4) is a sleeve.

8. Articulated bogie according to claim 1, wherein each elastic support (7) includes a block of rubber (7) enclosed between an outer cup member (61) rigidly fixed to said primary cross member (6) and a central pin (31) rigidly fixed to said equalizing bar (3).

* * * * *